US008938184B2

(12) United States Patent
Galaviz Martinez

(10) Patent No.: US 8,938,184 B2
(45) Date of Patent: Jan. 20, 2015

(54) METHODS AND DEVICES FOR REMANUFACTURING PRINTER CARTRIDGE COMPONENTS

(71) Applicant: Mitsubishi Kagaku Imaging Corporation, San Fernando, CA (US)

(72) Inventor: Rafeal Omar Galaviz Martinez, Tijuana (MX)

(73) Assignee: Mitsubishi Kagaku Imaging Corporation, Glendale, CA (US)

( * ) Notice: Subject to any disclaimer, the term of this patent is extended or adjusted under 35 U.S.C. 154(b) by 8 days.

(21) Appl. No.: 13/987,186

(22) Filed: Jul. 8, 2013

(65) Prior Publication Data

US 2014/0010570 A1 Jan. 9, 2014

Related U.S. Application Data

(60) Provisional application No. 61/690,997, filed on Jul. 9, 2012.

(51) Int. Cl.
*G03G 15/00* (2006.01)
*G03G 21/18* (2006.01)

(52) U.S. Cl.
CPC ..... *G03G 21/181* (2013.01)
USPC ..... 399/109

(58) Field of Classification Search
USPC ..... 399/109
See application file for complete search history.

(56) References Cited

U.S. PATENT DOCUMENTS

| | | | | |
|---|---|---|---|---|
| 2002/0057924 | A1* | 5/2002 | Ueno et al. | 399/117 |
| 2010/0067943 | A1* | 3/2010 | Zogg et al. | 399/109 |
| 2010/0142991 | A1* | 6/2010 | Holmes et al. | 399/109 |
| 2012/0275816 | A1* | 11/2012 | Holmes et al. | 399/109 |
| 2012/0275817 | A1* | 11/2012 | Holmes et al. | 399/109 |
| 2012/0275818 | A1* | 11/2012 | Holmes et al. | 399/109 |
| 2014/0029977 | A1* | 1/2014 | Taguchi | 399/109 |

* cited by examiner

*Primary Examiner* — G. M. Hyder

(57) ABSTRACT

There is provided a method for remanufacturing a printer cartridge component. The method includes providing a printer cartridge component having a flanged organic photoconductor (OPC) drum with a flange portion and a cylinder portion. The flange portion has a drum cylinder engagement end attached and inserted in a locked position with a flange lock in a first end of the cylinder portion. The method further includes unlocking the flange lock so that the flange portion is in an unlocked position in the first end of the cylinder portion. The method further includes securing the unlocked flange portion. The method further includes removing the cylinder portion from the secured unlocked flange portion to obtain a removed cylinder portion and a removed flange portion. The method further includes assembling the removed flange portion with a replacement OPC drum cylinder portion to obtain a remanufactured printer cartridge component.

20 Claims, 13 Drawing Sheets

METHODS AND DEVICES FOR REMANUFACTURING PRINTER CARTRIDGE COMPONENTS

CROSS REFERENCE TO RELATED APPLICATION

This application claims the benefit of U.S. Provisional Patent Application Ser. No. 61/690,997, filed Jul. 9, 2013, which is incorporated herein by reference in its entirety.

BACKGROUND a. Field of the Invention

The invention relates to methods and devices for remanufacturing printer cartridge components, and in particular, to methods and devices for remanufacturing laser printer cartridge components by replacing organic photoconductor (OPC) drum flanges on flanged organic photoconductor (OPC) drums.

b. Background Art

Printer cartridges, such as toner cartridges, are used in various electrophotographic imaging devices, such as laser printers, copiers, facsimile machines, and multifunction imaging devices. Once original equipment manufacturer (OEM) printer cartridges are used, they are often recycled and remanufactured. The process of remanufacturing a printer cartridge may include cleaning the cartridge, repairing damaged parts, replacing worn parts, reassembling with new parts, and replenishing the cartridge with toner. The process of remanufacturing a printer cartridge requires that the printer cartridge be disassembled so that access to the various parts can be achieved, and further requires that the printer cartridge be reassembled for subsequent use.

Printer cartridges typically include organic photoconductive (OPC) drums that may be designed to be electrically charged to be able to attract toner. A flanged OPC drum typically comprises a drum cylinder portion and a flange portion, where the flange portion may be inserted into one end of the drum cylinder portion and may be attached to that end of the drum cylinder portion with an adhesive or glue and/or a known attachment or assembly process. One known attachment or assembly process may include a crimping process that involves crimping or pinching of the end of the drum cylinder portion once the flange portion is inserted in order to keep the flange portion in place. The OPC drum cylinder portion may wear out from usage at a faster rate than the flange portion and may need to be replaced during remanufacturing, while the flange portion may be reused. However, the flange portion may be attached to the OPC drum cylinder portion in a manner that makes the flange portion difficult to remove from the OPC drum cylinder portion and when removal of the flange portion from the OPC drum cylinder portion is attempted, such removal may cause damage to the flange portion so that the flange portion could not be reused. For example, such known flanged OPC drums with attached flange portions for color laser printer applications may include a flange lock on the flange portion that helps to lock the flange portion in place and/or to the OPC drum cylinder portion. Further, such flange portion may also include a grounding plate with contact portions attached to the flange portion. During remanufacturing of such known OPC flange portions attached to known OPC drum cylinder portions, known hand tools, such as screwdrivers, pliers, spring hooks, and scraping tools, may be typically used to pry off and separate the flange portion from the OPC drum cylinder portion and/or may be used to push out and remove the flange portion from the OPC drum cylinder portion in order to remove the flange portion from the OPC drum cylinder portion. However, if not used carefully and properly, such known hand tools may damage the flange portion, such as the plastic walls of the flange portion, or may damage the grounding plate or contact portions of the grounding plate, or other portions of the flange portion. In particular, damage to the plastic walls of the flange portion or damage to the grounding plate or contact portions of the grounding plate may affect or prevent reuse and remanufacturing of the used flange portion with a replacement OPC drum cylinder portion.

It is thus desirable to be able to remove and replace the used flange portion on a used flanged OPC drum without damage to the used flange portion, including the plastic walls of the flange portion, the grounding plate of the flange portion and the contact portions of the grounding plate. This helps preserve the appearance of the used flange portion, the ability to reuse and reassemble the used flange portion, and minimizes remanufacturing steps. Devices and methods for efficiently and quickly removing a used OPC flange portion from a used OPC drum cylinder portion, and reusing the used OPC flange portion with a replacement or new OPC drum cylinder portion are desired.

Accordingly, there is a need for an improved method and device for remanufacturing printer cartridge components, including reusing used OPC flange portions of used flanged OPC drums and attaching or assembling such used OPC flange portions to replacement OPC drum cylinder portions, that overcomes the issues associated with known devices and methods.

SUMMARY

This need for an improved method and device for remanufacturing printer cartridge components, including reusing used OPC flange portions of used OPC drums and attaching or assembling such used OPC flange portions to replacement OPC drum cylinder portions, is satisfied.

There is provided in one embodiment a method for remanufacturing a printer cartridge component. The method comprises providing a printer cartridge component comprising a flanged organic photoconductor (OPC) drum having a flange portion and a cylinder portion. The flange portion has a drum cylinder engagement end attached and inserted in a locked position with a flange lock in a first end of the cylinder portion. The method further comprises unlocking the flange lock so that the flange portion is in an unlocked position in the first end of the cylinder portion. The method further comprises securing the unlocked flange portion. The method further comprises removing the cylinder portion from the secured unlocked flange portion to obtain a removed cylinder portion and a removed flange portion. The method further comprises assembling the removed flange portion with a replacement OPC drum cylinder portion to obtain a remanufactured printer cartridge component.

There is provided in another embodiment a method for removing a flange portion of a flanged organic photoconductive (OPC) drum. The method comprises providing a used flanged organic photoconductor (OPC) drum having a flange portion and a cylinder portion. The flange portion has a drum cylinder engagement end attached and inserted in a locked position with a flange lock in a first end of the cylinder portion and has a flange projection end. The method further comprises providing a flange lock unlocking device. The flange lock unlocking device comprises an unlocking portion having a flange projection engagement end and a base portion attached to the unlocking portion. The method further comprises coupling the flange projection end of the flange portion to the flange projection engagement end of the flange lock unlocking device. The method further comprises rotating the flange projection end to unlock the flange lock so that the flange portion is in an unlocked position in the first end of the cylinder portion. The method further comprises providing a flange removal device. The flange removal device comprises a platform portion, a flange portion retaining element attached to the platform portion, and a drum cylinder portion retaining portion attached to the platform. The method further comprises securing the unlocked flange portion to the flange portion retaining element. The method further comprises removing the cylinder portion from the secured unlocked flange portion to obtain a removed cylinder portion and a removed flange portion. The method further comprises assembling the removed flange portion with a replacement OPC drum cylinder portion to obtain a remanufactured flanged OPC drum.

There is provided in another embodiment an organic photoconductor (OPC) drum flange removal assembly for removing a flange portion of a flanged organic photoconductive (OPC) drum. The assembly comprises a flange lock unlocking device. The flange lock unlocking device comprises an unlocking portion having a flange projection engagement end, and a base portion attached to the unlocking portion. The assembly further comprises a flange removal device. The flange removal device comprises a platform portion, a flange portion retaining element attached to the platform portion, and a drum cylinder portion retaining portion attached to the platform. The flange lock unlocking device unlocks a flange lock on a flange portion of a flanged organic photoconductive (OPC) drum, so that the flange portion is in an unlocked position. The flange removal device secures the unlocked flange portion, so that the cylinder portion can be removed from the secured unlocked flange portion to obtain a removed cylinder portion and a removed flange portion.

The above description sets forth, rather broadly, a summary of the disclosed embodiments so that the detailed description that follows may be better understood and contributions of the invention to the art may be better appreciated. Some of the disclosed embodiments may not include all of the features or characteristics listed in the above summary. There may be, of course, other features of the disclosed embodiments that will be described below and may form the subject matter of claims. The features, functions, and advantages that have been discussed can be achieved independently in various embodiments of the disclosure or may be combined in yet other embodiments further details of which can be seen with reference to the following description and drawings.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The disclosed embodiments provide various devices and methods for remanufacturing printer cartridges, such as toner cartridges, and in particular, for removing and replacing an organic photoconductor ("OPC") drum in a printer cartridge and installing a replacement OPC drum in a printer cartridge. The disclosed embodiments of the devices and methods may be used with printer cartridge components that can be used in laser printer models, such as Hewlett Packard Corporation HP 1215, HP2600, HP2025, HP3525, HP425 families of laser printers, or other HP laser printer models, and may also be used with other suitable printer cartridges.

Figure 12:
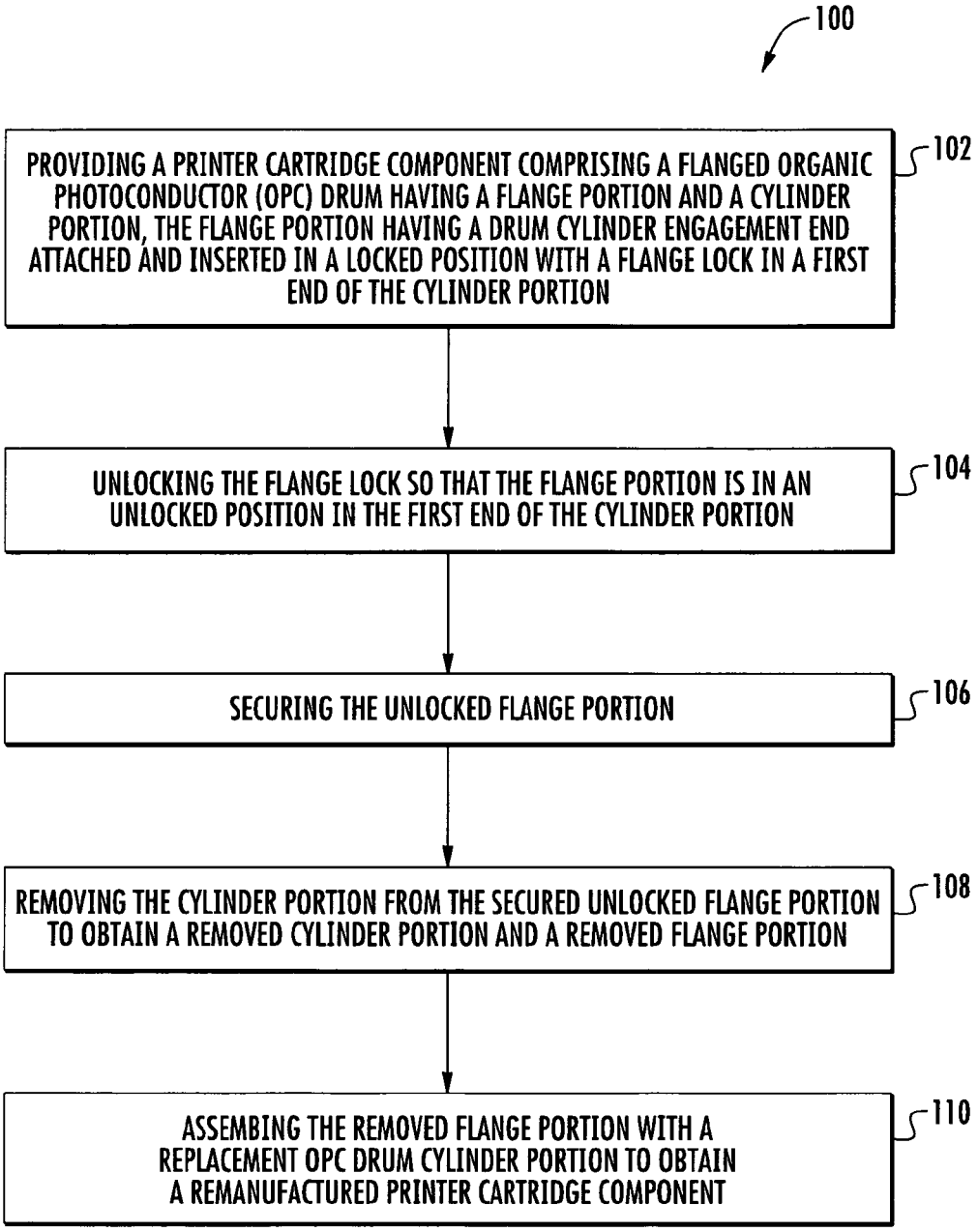
FIG. 12 is a flow diagram of one of the embodiments of a method for remanufacturing a printer cartridge component of the disclosure; and, FIG. 13 is a flow diagram of another one of the embodiments of a method for remanufacturing a printer cartridge component of the disclosure.

Referring to the Figures, FIG. 12 a flow diagram of one of the embodiments of a method 100 for remanufacturing a printer cartridge component of the disclosure. There is provided in one embodiment a method 100 for remanufacturing a printer cartridge component 10 (see FIG. 1A). The method 100 comprises step 102 of providing a printer cartridge component 10 (see FIG. 1A) comprising a flanged organic photoconductor (OPC) drum 12 (see FIG. 1A) having a flange portion 14 (see FIG. 1A) and a cylinder portion 16 (see FIG. 1A). The flange portion 14 (see FIG. 1A) preferably has a drum cylinder engagement end 18 (see FIG. 1A) attached and inserted in a locked position 20 (see FIG. 1A) with a flange lock 22 (see FIG. 1A) in a first end 24 (see FIG. 1A) of the cylinder portion 16 (see FIG. 1A).

Figure 4B:
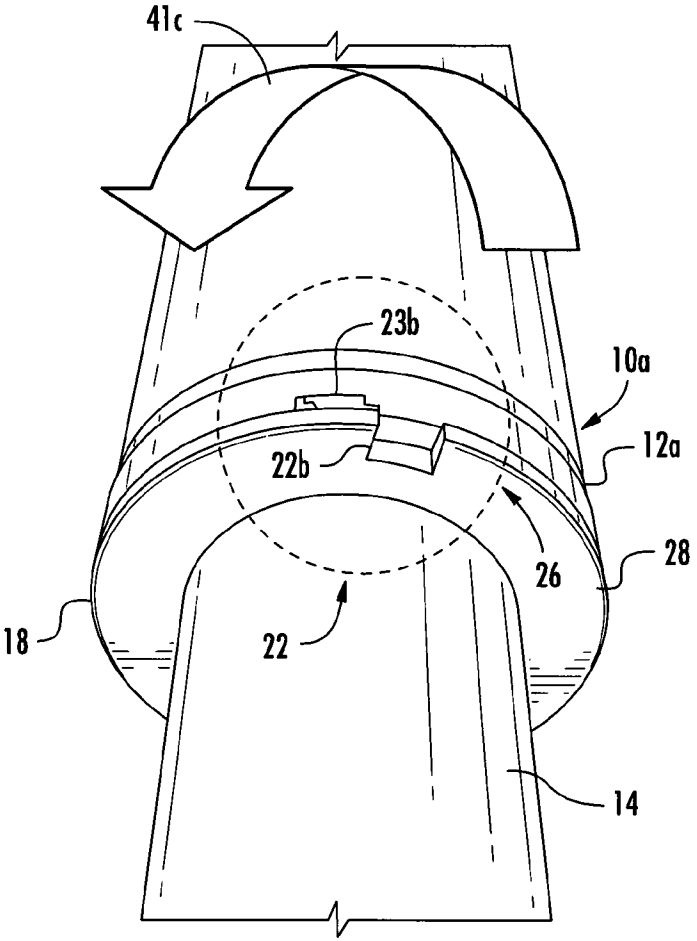
FIG. 4B is a front perspective close-up view of a broken or unlocked second flange lock portion of the known OPC flange portion after being broken or unlocked by the flange lock unlocking device.
Figure 4A:
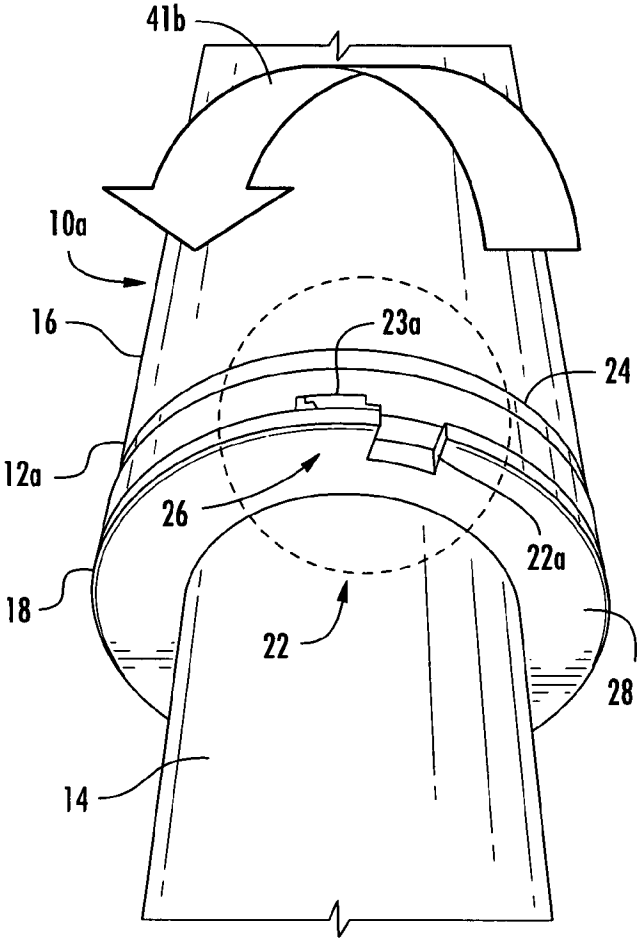
FIG. 4A is a front perspective close-up view of a broken or unlocked first flange lock portion of the known OPC flange portion after being broken or unlocked by the flange lock unlocking device.

The method 100 (see FIG. 12) further comprises step 104 of unlocking the flange lock 22 (see FIG. 1A) so that the flange portion 14 (see FIG. 1A) is in an unlocked position 26 (see FIG. 4A) in the first end 24 (see FIG. 4A) of the cylinder portion 16 (see FIG. 4A). The method 100 (see FIG. 12) further comprises step 106 of securing the unlocked flange portion 28 (see FIG. 6). The method 100 (see FIG. 12) further comprises step 108 of removing the cylinder portion 16 (see FIG. 7) from the secured unlocked flange portion 28 (see FIG. 7) to obtain a removed cylinder portion 30 (see FIG. 9A) and a removed flange portion 32 (see FIG. 9B). The method 100 (see FIG. 12) further comprises step 110 of assembling the removed flange portion 32 (see FIG. 9B) with a replacement OPC drum cylinder portion 34 (see FIG. 11A) to obtain a remanufactured printer cartridge component 35 (see FIG. 11A).

Figures 1A, 1B, 1C:
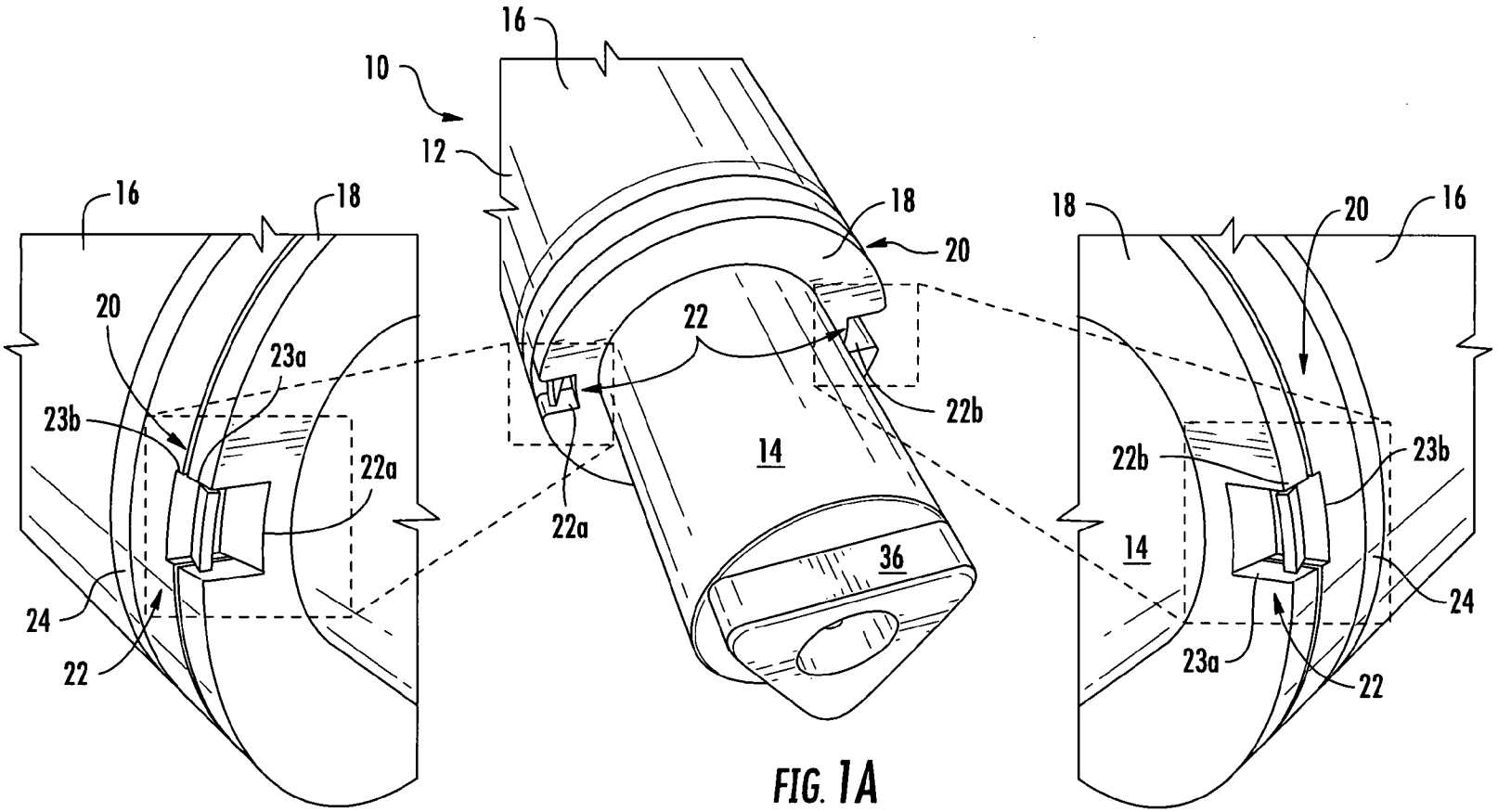
FIG. 1A shows a front top perspective view of a first flange lock portion and a second flange lock portion of a known OPC flange portion attached to a known OPC drum cylinder portion for which disclosed embodiments of the method and device of the disclosure may be applied.
FIG. 1B shows a front side perspective close-up view of the first flange lock portion of FIG. 1A for which disclosed embodiments of the method and device of the disclosure may be applied.
FIG. 1C shows a front side perspective close-up view of the second flange lock portion of FIG. 1A for which disclosed embodiments of the method and device of the disclosure may be applied.
Figure 13:
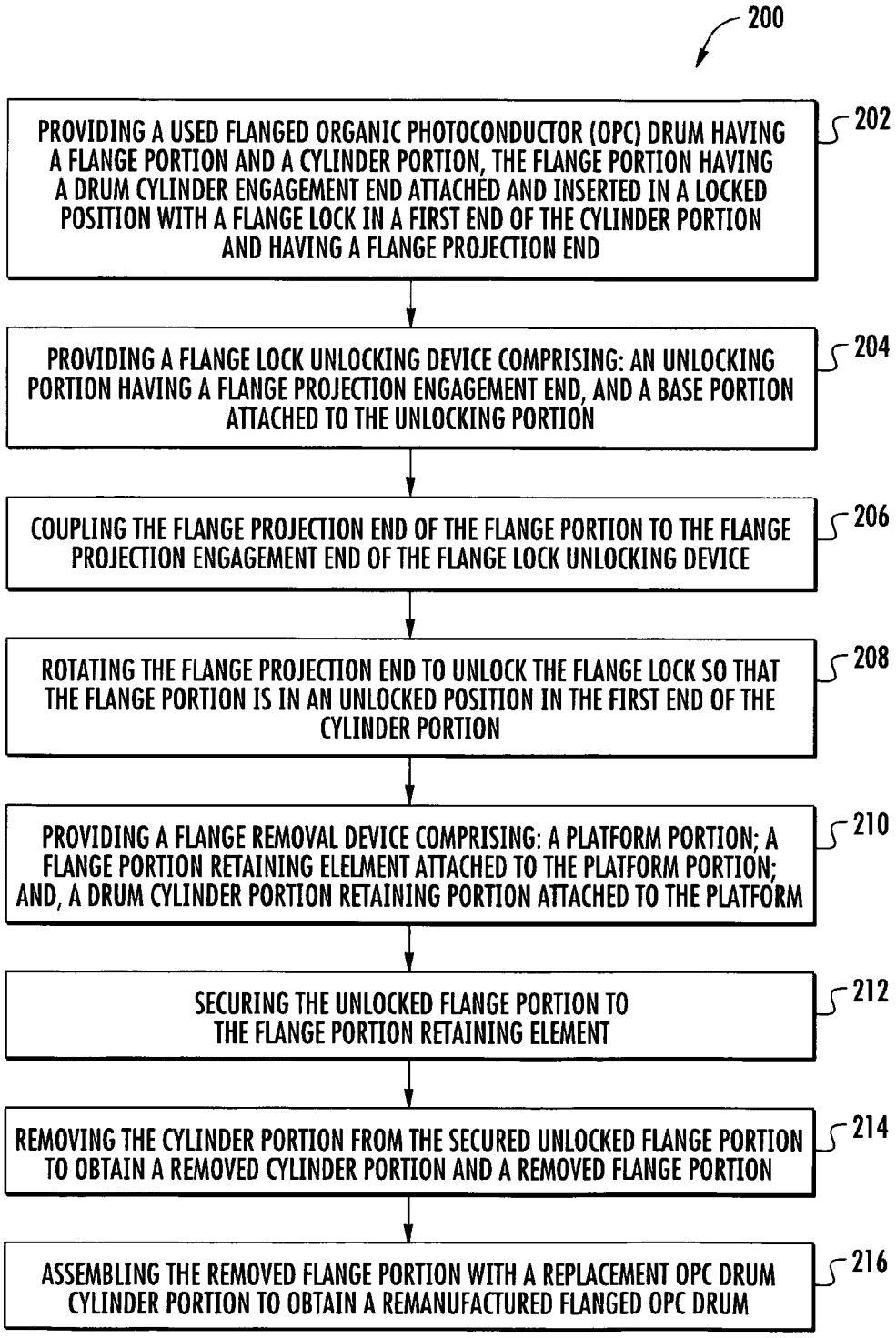

There is provided in another embodiment a method 200 (see FIG. 13) for removing a flange portion 14 (see FIG. 1A) of a flanged organic photoconductive (OPC) drum 12 (see FIG. 1A). FIG. 13 is a flow diagram of another one of the embodiments of the method 200 for remanufacturing a printer cartridge component 10 (see FIG. 1A) of the disclosure. The method 200 (see FIG. 13) comprises step 202 of providing a used flanged organic photoconductor (OPC) drum 12*a* (see FIG. 3) having a flange portion 14 (see FIG. 3) and a cylinder portion 16 (see FIG. 3). The flange portion 14 (see FIG. 3) has a drum cylinder engagement end 18 (see FIG. 3) attached and inserted in a locked position 20 (see FIG. 1A) with a flange lock 22 (see FIG. 3) in a first end 24 (see FIG. 4A) of the cylinder portion 16 (see FIG. 3) and has a flange projection end 36 (see FIG. 2B).

Figure 2B:
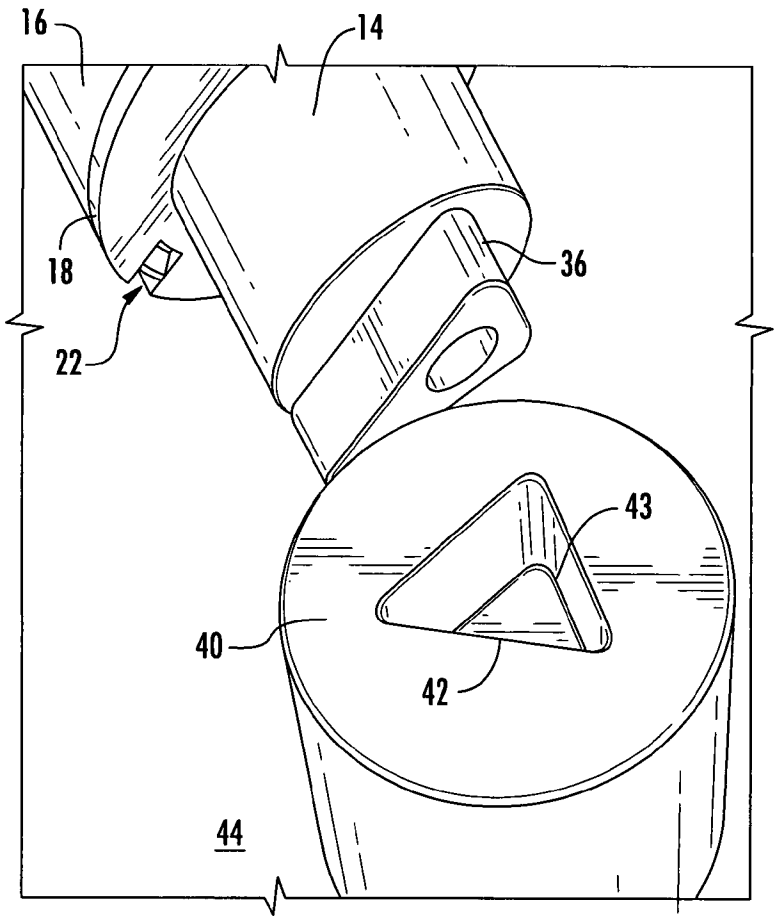
FIG. 2B is a top perspective view of the flange lock unlocking device of FIG. 2A with one end of the known used OPC flange portion of the known flanged OPC drum about to be inserted into a corresponding opening on one end of the flange lock unlocking device.
Figure 2A:
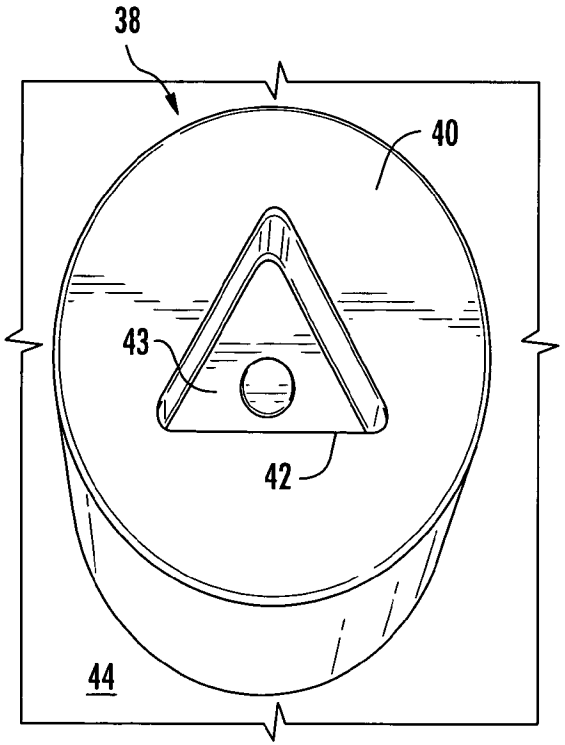
FIG. 2A is a top perspective view of an embodiment of a flange lock unlocking device of the disclosure.

The method 200 (see FIG. 13) further comprises step 204 of providing a flange lock unlocking device 38 (see FIG. 2A). As shown in FIG. 2A, the flange lock unlocking device 38 comprises an unlocking portion 40 having a flange projection engagement end 42 and a base portion 44 attached to the unlocking portion 40.

The method 200 further comprises step 206 of coupling the flange projection end 36 (see FIG. 2B) of the flange portion 14 (see FIG. 2B) to the flange projection engagement end 42 (see FIGS. 2A-2B) of the flange lock unlocking device 38 (see FIG. 2A). The method 200 (see FIG. 13) further comprises step 208 of rotating the flange projection end 36 (see FIG. 2B) to unlock the flange lock 22 (see FIG. 3) so that the flange portion 14 (see FIG. 3) is in an unlocked position 26 (see FIG. 4A) in the first end 24 (see FIG. 4A) of the cylinder portion 16 (see FIG. 4A).

Figure 5:
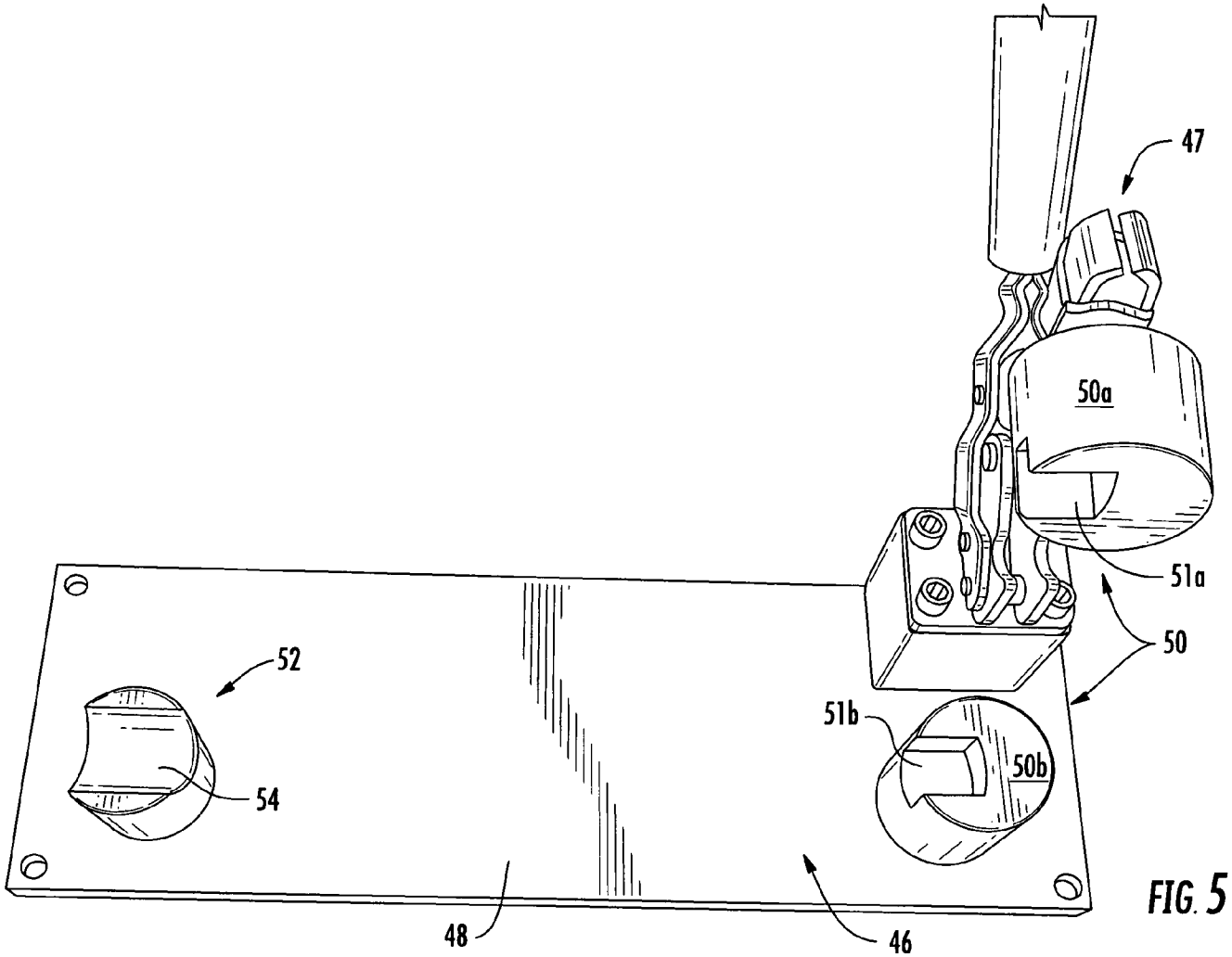
FIG. 5 is a top perspective view of an embodiment of a flange removal device of the disclosure.

The method 200 (see FIG. 13) further comprises step 210 of providing a flange removal device 46 (see FIG. 5). The flange removal device 46 (see FIG. 5) comprises a platform portion 48 (see FIG. 5), a flange portion retaining element 50 (see FIG. 5) attached to the platform portion 48 (see FIG. 5), and a drum cylinder portion retaining portion 52 (see FIG. 5) attached to the platform portion 48 (see FIG. 5).

Figure 6:
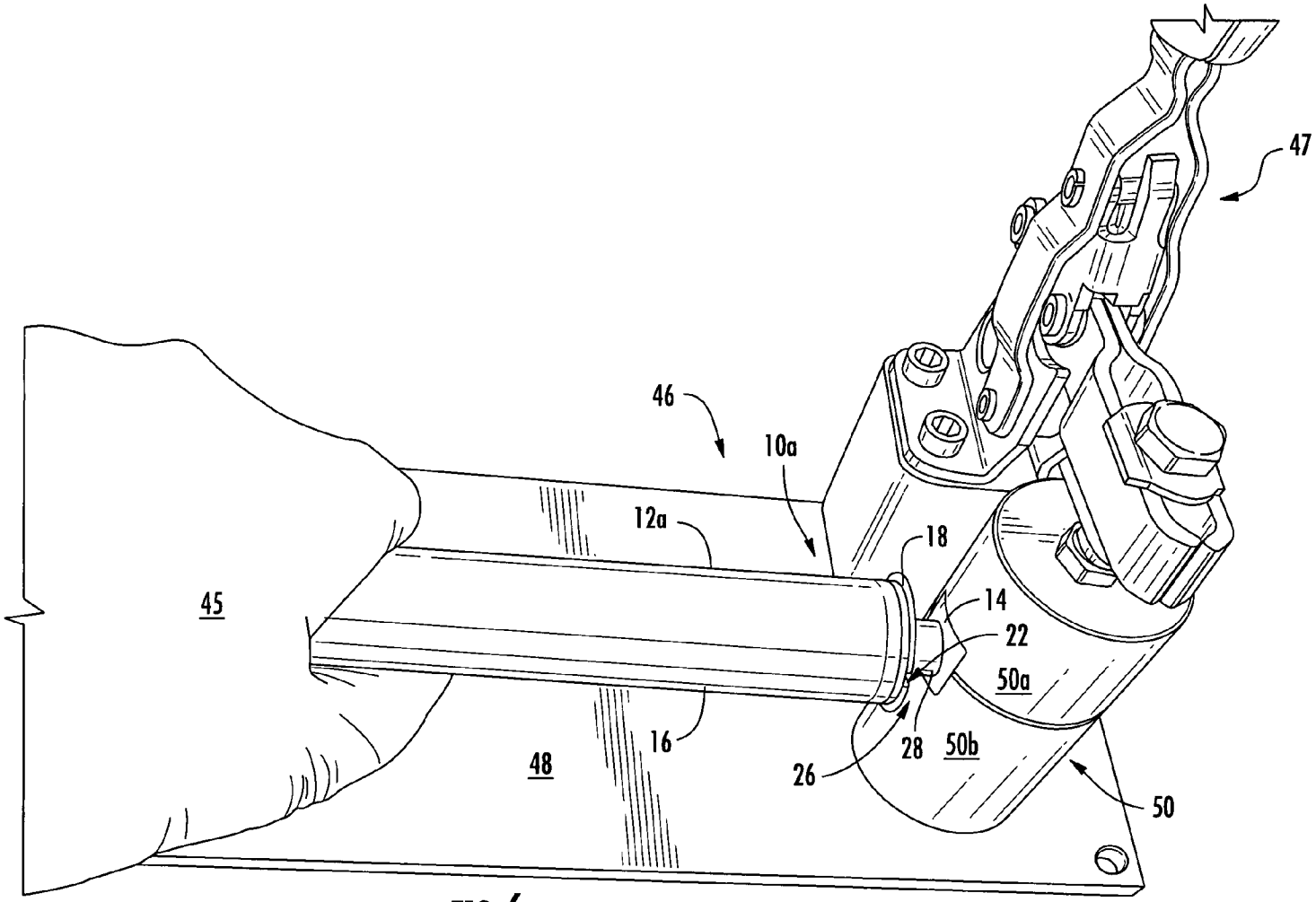
FIG. 6 is a top perspective view of the flange removal device of FIG. 5 where a user holds the known OPC drum cylinder portion and the attached known OPC flange portion is retained in a flange portion retaining element of the flange removal device.

The method 200 (see FIG. 13) further comprises step 212 of securing the unlocked flange portion 14 (see FIG. 6) to the flange portion retaining element 50 (see FIG. 6). As shown in FIG. 6, the flange portion retaining element 50 comprises a first flange portion retaining element 50*a* and a second flange portion retaining element 50*b*.

Figure 9B:
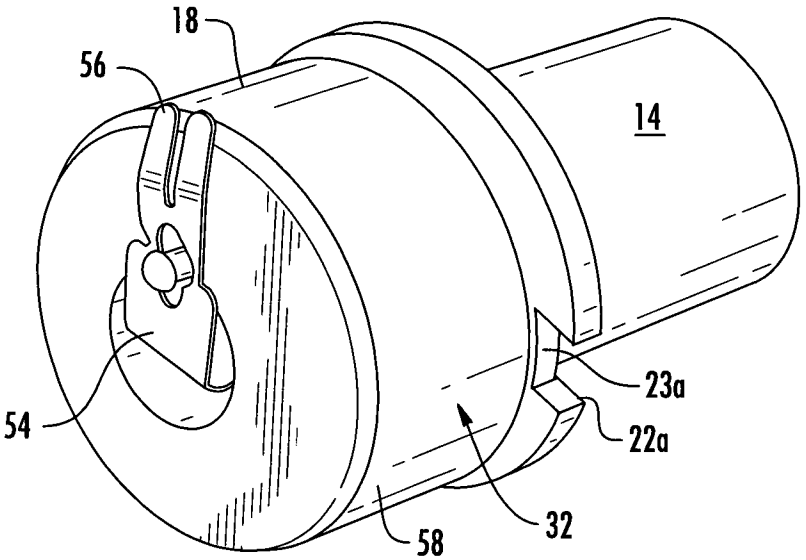
FIG. 9B is a top perspective view of the removed flange portion completely disconnected or removed from the removed cylinder portion.

The method 200 (see FIG. 13) further comprises step 214 of removing the cylinder portion 16 (see FIG. 7) from the secured unlocked flange portion 28 (see FIG. 6) to obtain a removed cylinder portion 30 (see FIG. 9A) and a removed flange portion 32 (see FIG. 9B). The method 200 (see FIG. 13) further comprises step 216 of assembling the removed flange portion 32 (see FIG. 9B) with a replacement OPC drum cylinder portion 34 (see FIG. 11A) to obtain a remanufactured flanged OPC drum 35 (see FIG. 11A).

Figure 3:
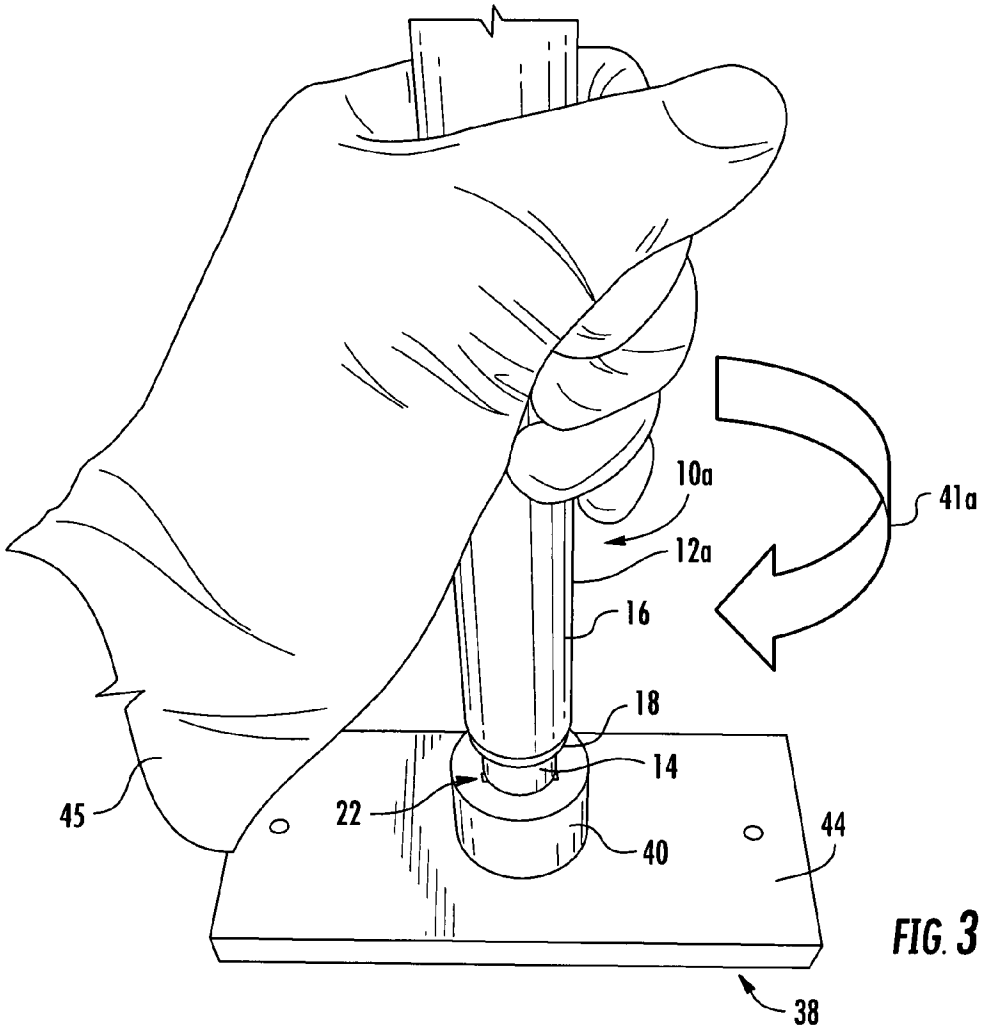
FIG. 3 is a top perspective view of the flange portion of a used flanged OPC drum inserted into the corresponding opening on one end of the flange lock unlocking device and a user rotating the known OPC drum cylinder or cylinder and simultaneously rotating the attached known OPC flange portion.

There is provided in another embodiment an organic photoconductor (OPC) drum flange removal assembly 37 (see FIGS. 3 and 5) for removing a flange portion 14 (see FIG. 2B) of a flanged organic photoconductive (OPC) drum 12 (see FIG. 1A), such as used flanged OPC drum 12*a* (see FIG. 3). The (OPC) drum flange removal assembly 37 (see FIGS. 3 and 5) comprises a flange lock unlocking device 38 (see FIG. 3). As shown in FIG. 3, the flange lock unlocking device 38 comprises an unlocking portion 40 having a flange projection engagement end 42 (see FIG. 2B), and a base portion 44 attached to the unlocking portion 40.

The (OPC) drum flange removal assembly 37 (see FIGS. 3 and 5) further comprises a flange removal device 46 (see FIG. 5). As shown in FIG. 5, the flange removal device 46 comprises a platform portion 48, a flange portion retaining element 50 attached to the platform portion 48, and a drum cylinder portion retaining portion 52 attached to the platform portion 48. As further shown in FIG. 5, the flange portion retaining element 50 comprises a first flange portion retaining element 50*a* and a second flange portion retaining element 50*b*. The first flange portion retaining element 50*a* (see FIG.

5) is attached to a clamp element 47 (see FIG. 5). The first flange portion retaining element 50*a* has a first cut-out portion 51*a* (see FIG. 5) adapted to receive a portion of the flange portion 14 (see FIG. 6), preferably an upper half portion of the flange portion 14 (see FIG. 6). The second flange portion retaining element 50*b* (see FIG. 5) is attached to the platform portion (see FIG. 5). The second flange portion retaining element 50*b* has a second cut-out portion 51*b* (see FIG. 5) adapted to receive a portion of the flange portion 14 (see FIG. 6), preferably a lower half portion of the flange portion 14 (see FIG. 6).

The flange lock unlocking device 38 (see FIG. 3) unlocks a flange lock 22 (see FIG. 3) on a flange portion 14 (see FIG. 3) of a flanged organic photoconductive (OPC) drum 12 (see FIG. 1A), such as a used flanged organic photoconductive (OPC) drum 12*a* (see FIG. 3), so that the flange portion 14 (see FIG. 3) is in an unlocked position 26 (see FIG. 4A). The flange removal device 46 (see FIG. 6) secures the unlocked flange portion 28 (see FIG. 6), so that the cylinder portion 16 (see FIG. 6) can be removed from the secured unlocked flange portion 28 (see FIG. 6) to obtain a removed cylinder portion 30 (see FIG. 9A) and a removed flange portion 32 (see FIG. 9B).

FIG. 1A shows a front top perspective view of a printer cartridge component 10, such as in the form of a flanged organic photoconductor (OPC) drum 12. As shown in FIG. 1A, the printer cartridge component 10 comprises a flange portion 14, such as a known OPC flange portion, having a flange projection end 36 and a drum cylinder engagement end 18. As further shown in FIG. 1A, the printer cartridge component 10 further comprises a cylinder portion 16, such as a known OPC drum cylinder portion. The cylinder portion 16 has a first end 24 (see FIG. 1B) attached to the drum cylinder engagement end 18.

As further shown in FIG. 1A, the printer cartridge component 10 further comprises a flange lock 22. The flange lock 22 comprises a first flange lock portion 22*a* (see FIG. 1A) and a second flange lock portion 22*b* (see FIG. 1A) of the known OPC flange portion 14, such as the known OPC flange portion, attached to the cylinder portion 16, such as the known OPC drum cylinder portion, for which disclosed embodiments of the method 100 (see FIG. 12) and method 200 (see FIG. 13) and device of the disclosure may be applied.

FIG. 1B shows a front side perspective close-up view of the first flange lock portion 22*a* of the flange lock 22 of FIG. 1A for which disclosed embodiments of the method 100 (see FIG. 12) and method 200 (see FIG. 13) and devices of the disclosure may be applied. As shown in FIG. 1B, the first flange lock portion 22*a* comprises a flange notch 23*a* and a cylinder notch 23*b*. As further shown in FIG. 1B, the flange notch 23*a* and the cylinder notch 23*b* correspond to each other when the flange lock 22 is in the locked position 20.

FIG. 1C shows a front side perspective close-up view of the second flange lock portion 22*b* of the flange lock 22 of FIG. 1A for which disclosed embodiments of the method 100 (see FIG. 12) and method 200 (see FIG. 13) and devices of the disclosure may be applied. As shown in FIG. 1C, the second flange lock portion 22*b* comprises a flange notch 23*b* and a cylinder notch 23*b*. As further shown in FIG. 1B, the flange notch 23*a* and the cylinder notch 23*b* correspond to each other when the flange lock 22 is in the locked position 20 (see FIG. 1A).

FIG. 2A is a top perspective view of an embodiment of a flange lock unlocking device 38 of the disclosure. FIG. 2B is a top perspective view of the flange lock unlocking device 38 of FIG. 2A with one end of the flange portion 14, such as the known used OPC flange portion, of the flanged OPC drum 12 (see FIG. 1A), such as a known flanged OPC drum, about to be inserted into a corresponding opening 43 of the flange projection engagement end 42 on one end of the unlocking portion 40 of the flange lock unlocking device 38 (see FIG. 2A).

FIG. 3 is a top perspective view of the flange portion 14, such as the known used OPC flange portion, of a used flanged OPC drum 12*a* inserted into the corresponding opening on one end of the flange lock unlocking device 38 and a user 45 rotating in a rotational direction shown by arrow 41*a* the cylinder portion 16 and simultaneously rotating the attached flange portion 14.

FIG. 4A is a front perspective close-up view of a broken or unlocked first flange lock portion 22*a* with cylinder notch 23*a* of the flange portion 14, such as the known OPC flange portion, after being broken or unlocked by the flange lock unlocking device 38. As shown in FIG. 4A, the drum cylinder is rotated in a rotational direction shown by arrow 41*b* to unlock the flange lock 22 so that it is in an unlocked position 26.

FIG. 4B is a front perspective close-up view of a broken or unlocked second flange lock portion 22*b* with cylinder notch 23*b* of the flange portion 14 after being broken or unlocked by the flange lock unlocking device 38. As shown in FIG. 4A, the drum cylinder is rotated in a rotational direction shown by arrow 41*c* to unlock the flange lock 22 so that it is in an unlocked position 26.

FIG. 5 is a top perspective view of an embodiment of the flange removal device 46 discussed above of the disclosure. FIG. 6 is a top perspective view of the flange removal device 46 of FIG. 5 where a user 45 holds the cylinder portion 16, such as the known OPC drum cylinder portion, and the flange portion 14, such as the attached known OPC flange portion, is retained in a flange portion retaining portion 50 of the flange removal device 46.

Figure 7:
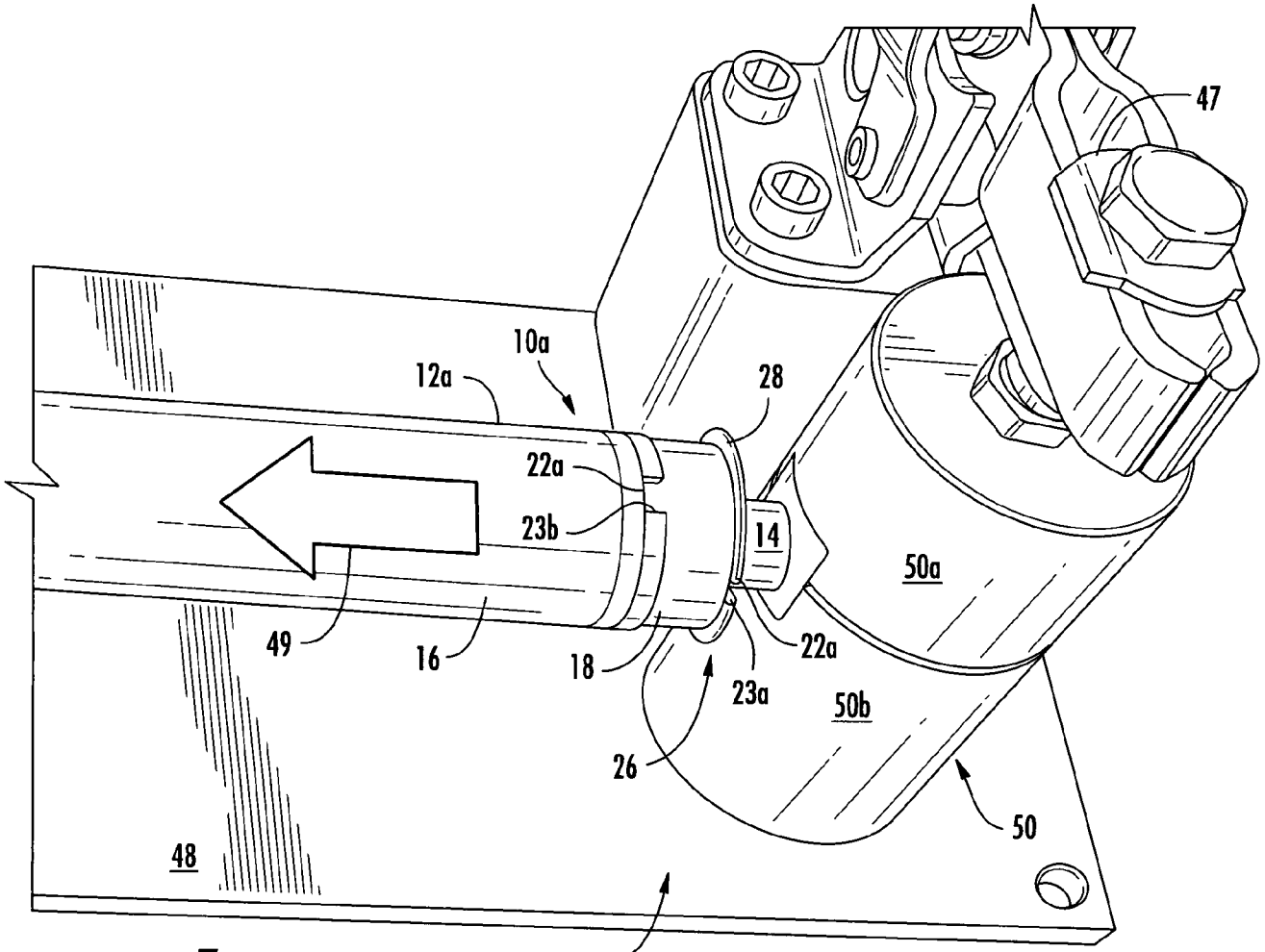
FIG. 7 is a top perspective view of the flange removal device of FIG. 5 showing the known OPC drum cylinder portion being pulled out and away from the known OPC flange portion which remains retained in the flange portion retaining element of the flange removal device.

FIG. 7 is a top perspective view of the flange removal device 46 of FIG. 5 showing the cylinder portion 16, such as the known OPC drum cylinder portion, being pulled out and away from the flange portion 14, such as the known OPC flange portion, which remains retained in the flange portion retaining portion 50 of the flange removal device 46. FIG. 7 shows the cylinder portion 16 being removed from the flange portion 14 in a direction shown by arrow 49.

Figure 8:
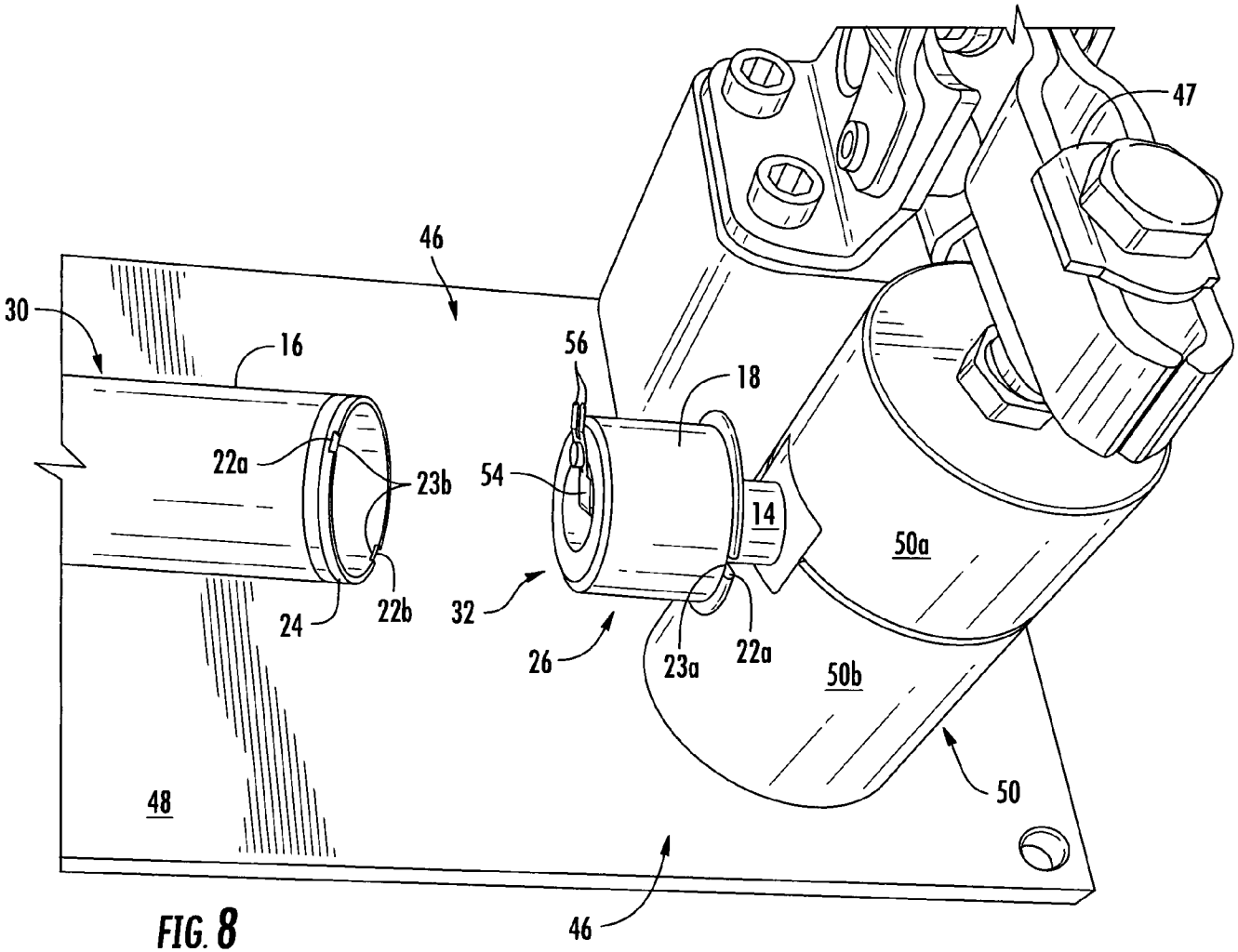
FIG. 8 is a top perspective view of the flange removal device of FIG. 5 showing the known OPC drum cylinder portion completely disconnected or removed from the known OPC flange portion which remains retained in the flange portion retaining element of the flange removal device.

FIG. 8 is a top perspective view of the flange removal device 46 of FIG. 5 showing the cylinder portion 16, such as known OPC drum cylinder portion, completely disconnected or removed from the flange portion 14, such as known OPC flange portion, which remains retained in the flange portion retaining element 50 of the flange removal device 46.

FIG. 9 is a top perspective view of the known OPC drum cylinder portion 16 completely disconnected or removed from the known used OPC flange portion 14 which shows no damage to the grounding plate 54, no damage to the contact portions 56 of the grounding plate 54 and no damage to the plastic walls 58 of the known OPC flange portion 14.

Figure 9A:
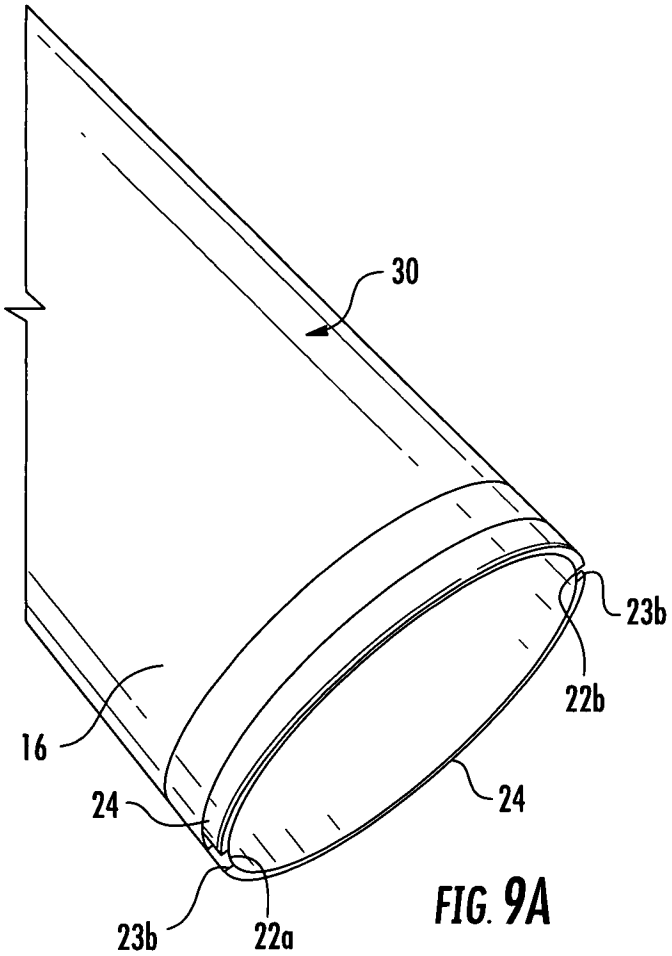
FIG. 9A is a top perspective view of the removed cylinder portion completely disconnected or removed from the removed flange portion.

FIG. 9A is a top perspective view of the removed cylinder portion 30 completely disconnected or removed from the removed flange portion 32 (see FIG. 9B). FIG. 9A shows the drum cylinder 16 with the first flange lock portion 22*a* with cylinder notch 23*b* and the second flange lock portion 22*b* with cylinder notch 23*b*.

FIG. 9B is a top perspective view of the removed flange portion 32 completely disconnected or removed from the removed cylinder portion 30. FIG. 9B shows the flange portion 14 with the drum cylinder engagement end 18 and the first flange lock portion 22*a* with flange notch 23*a*. FIG. 9B further shows no damage to the grounding plate 54, no damage to the contact portions 56 of the grounding plate 54 and no damage to the plastic walls 58 of the flange portion 14, such as the known OPC flange portion.

Figure 10:
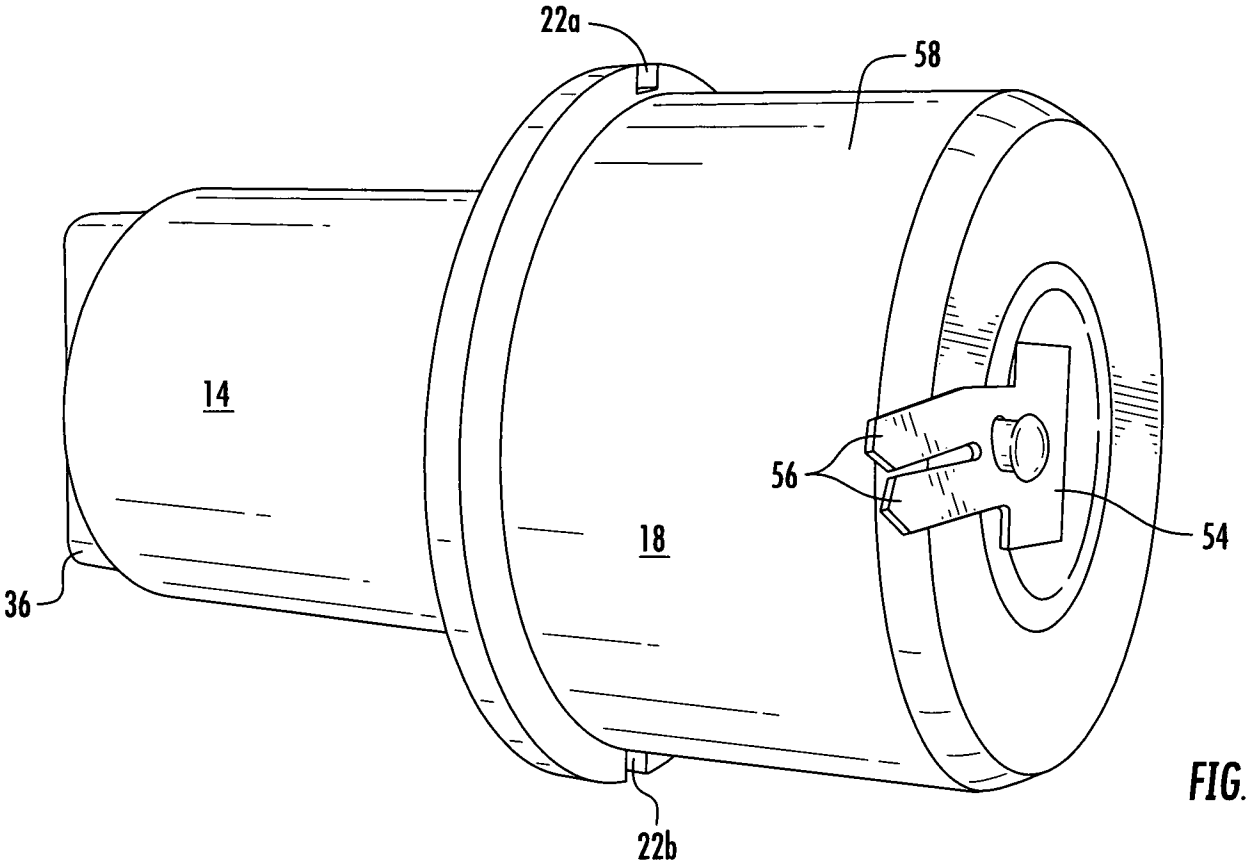
FIG. 10 is a side perspective view of the removed known used OPC flange portion showing no damage to the grounding plate, no damage to the contact portions of the grounding plate and no damage to the plastic walls of the known used OPC flange portion.

FIG. 10 is a side perspective view of the removed known used OPC flange portion 14 showing no damage to the grounding plate 54, no damage to the contact portions 56 of the grounding plate 54 and no damage to the plastic walls 58 of the known flange portion 14, such as the used OPC flange portion 14.

Figure 11A:
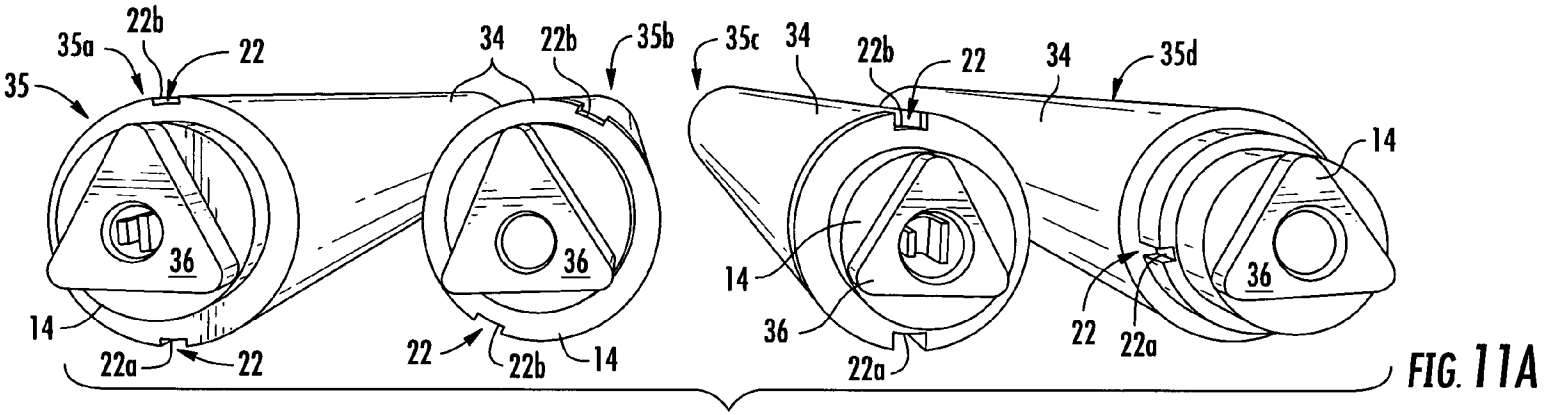
FIG. 11A is a front perspective view of various remanufactured flanged OPC drums for color printing applications showing the reused OPC flange portions assembled with replacement OPC drum cylinder portions.

FIG. 11A is a front perspective view of various remanufactured flanged OPC drums 35 for color printing applications showing the flange portions 14, such as reused OPC flange portions 14, assembled with replacement OPC drum cylinder portions 34. As shown in FIG. 11A, the remanufactured printer cartridge components 35 comprise remanufactured printer cartridge components 35*a*, 35*b*, 35*c*, 35*d*.

Figure 11B:
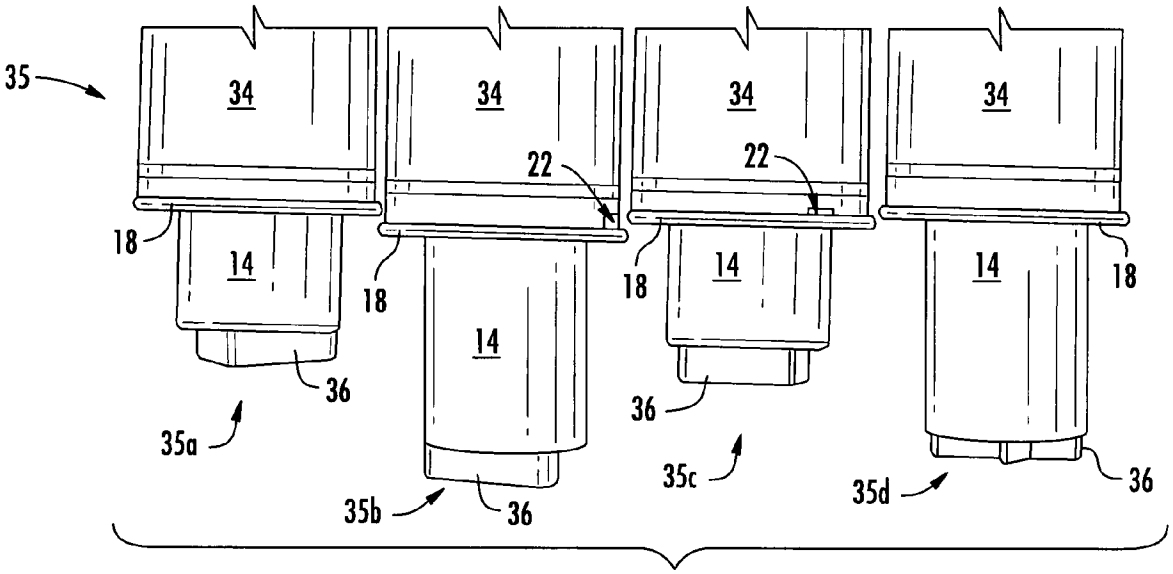
FIG. 11B is a top perspective view of the various remanufactured flanged OPC drums of FIG. 11B.

FIG. 11B is a top perspective view of the various remanufactured flanged OPC drums 35 of FIG. 11B having replacement OPC drum cylinder portions 34 attached to flange portions 14 via drum cylinder engagement ends 18. As shown in FIG. 11B, the remanufactured printer cartridge components 35 comprise remanufactured printer cartridge components 35*a*, 35*b*, 35*c*, 35*d*.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The invention is not limited in its application to the details of the construction and to the arrangement of the components set forth in the above description or as illustrated in the drawings.

What is claimed is:

1. A method for remanufacturing a printer cartridge component, the method comprising:

providing a printer cartridge component comprising a flanged organic photoconductor (OPC) drum having a flange portion and a cylinder portion, the flange portion having a drum cylinder engagement end attached and inserted in a locked position with a flange lock in a first end of the cylinder portion;

unlocking the flange lock so that the flange portion is in an unlocked position in the first end of the cylinder portion;

securing the unlocked flange portion;

removing the cylinder portion from the secured unlocked flange portion to obtain a removed cylinder portion and a removed flange portion; and, assembling the removed flange portion into a replacement OPC drum cylinder portion to obtain a remanufactured printer cartridge component.

2. The method of claim 1 further comprising installing the remanufactured printer cartridge component into a laser printer cartridge.

3. The method of claim 1 further comprising discarding the removed cylinder portion.

4. The method of claim 1 wherein the flange portion has a grounding plate with one or more contact portions.

5. The method of claim 1 wherein the flange lock on the flange portion comprises a first flange lock portion and a second flange lock portion positioned opposite the first flange lock portion.

6. The method of claim 1 wherein the removed flange portion is not damaged during the method.

7. The method of claim 1 wherein the method is a manual method.

8. The method of claim 1 wherein the method is an automated method.

9. A method for removing a flange portion of a flanged organic photoconductive (OPC) drum, the method comprising:

providing a used flanged organic photoconductor (OPC) drum having a flange portion and a cylinder portion, the flange portion having a drum cylinder engagement end attached and inserted in a locked position with a flange lock in a first end of the cylinder portion and having a flange projection end;

providing a flange lock unlocking device comprising:

an unlocking portion having a flange projection engagement end; and, a base portion attached to the unlocking portion;

coupling the flange projection end of the flange portion to the flange projection engagement end of the flange lock unlocking device;

rotating the flange projection end to unlock the flange lock so that the flange portion is in an unlocked position in the first end of the cylinder portion;

providing a flange removal device comprising:

a platform portion;

a flange portion retaining element attached to the platform portion; and, a drum cylinder portion retaining portion attached to the platform;

securing the unlocked flange portion to the flange portion retaining element;

removing the cylinder portion from the secured unlocked flange portion to obtain a removed cylinder portion and a removed flange portion; and, assembling the removed flange portion with a replacement OPC drum cylinder portion to obtain a remanufactured flanged OPC drum.

10. The method of claim 9 further comprising installing the remanufactured flanged OPC drum into a laser printer cartridge.

11. The method of claim 9 further comprising discarding the removed cylinder portion.

12. The method of claim 9 wherein the flange portion has a grounding plate with one or more contact portions.

13. The method of claim 9 wherein the flange lock on the flange portion comprises a first flange lock portion and a second flange lock portion positioned opposite the first flange lock portion.

14. The method of claim 9 wherein the removed flange portion is not damaged during the method.

15. The method of claim 9 wherein the method is a manual method.

16. The method of claim 9 wherein the method is an automated method.

17. An organic photoconductor (OPC) drum flange removal assembly for removing a flange portion of a flanged organic photoconductive (OPC) drum, the assembly comprising:

a flange lock unlocking device comprising:

an unlocking portion having a flange projection engagement end; and, a base portion attached to the unlocking portion; and, a flange removal device comprising:

a platform portion;

a flange portion retaining element attached to the platform portion; and, a drum cylinder portion retaining portion attached to the platform, wherein the flange lock unlocking device unlocks a flange lock on a flange portion of a flanged organic photoconductive (OPC) drum, so that the flange portion is in an unlocked position, and further wherein the flange removal device secures the unlocked flange portion, so that the cylinder portion can be removed from the secured unlocked flange portion to obtain a removed cylinder portion and a removed flange portion.

18. The assembly of claim 17 wherein the flange projection engagement end corresponds in shape and size to a flange projection end on the flange portion.

19. The assembly of claim 17 wherein the assembly is a manual operation assembly.

20. The assembly of claim 17 wherein the assembly is an automated operation assembly.

* * * * *